United States Patent [19]

Mattei

[11] Patent Number: 4,729,388

[45] Date of Patent: Mar. 8, 1988

[54] CIGARETTE MANUFACTURING MACHINE WITH A TOBACCO PARTICLE SEPARATOR

[75] Inventor: Riccardo Mattei, Bologna, Italy

[73] Assignee: G.D Societa' Per Azioni, Turin, Italy

[21] Appl. No.: 839,380

[22] Filed: Mar. 14, 1986

[30] Foreign Application Priority Data

Mar. 22, 1985 [IT] Italy ..... 3376 A/85

[51] Int. Cl.[4] ..... A24C 5/39

[52] U.S. Cl. ..... 131/109.2; 131/84.1; 131/84.3; 131/110

[58] Field of Search ..... 131/84.1, 84.3, 84.4, 131/109.1, 109.2, 110

[56] References Cited

U.S. PATENT DOCUMENTS

| | | | |
|---|---|---|---|
| 2,173,087 | 9/1939 | Eissmann | 131/109.2 |
| 3,362,414 | 1/1968 | Wochnowski | 131/110 |
| 3,871,385 | 3/1975 | David | 131/109.2 |
| 4,600,021 | 7/1986 | Mattei | 131/109.2 |
| 4,627,447 | 12/1986 | Brackmann et al. | 131/109.2 |

*Primary Examiner*—V. Millin

*Attorney, Agent, or Firm*—Marshall, O'Toole, Gerstein, Murray & Bicknell

[57] ABSTRACT

A cigarette manufacturing machine having a shredded tobacco supply unit, a unit for wrapping the shredded tobacco, an air permeable conveyor belt extending from the supply unit and the wrapping unit for transferring a continuous layer of tobacco held by vacuum on the belt to the wrapping unit; the supply unit comprising a down-flow duct for shredded tobacco, a well communicating with the bottom end of the down-flow duct, and an up-flow duct for the tobacco; the bottom end of the up-flow duct communicating with the well, and the top end of the up-flow duct being closed by the belt; and separating apparatus for separating unsuitable particles from the shredded tobacco for cigarette manufacture, with the separating apparatus having a duct substantially in the shape of an upside-down U; a tubular connection extending between the U-shaped duct and the well; a first end of the U-shaped duct communicating with a dump, and a second end of the U-shaped duct communicating with the down-flow duct.

7 Claims, 4 Drawing Figures

FIG.1
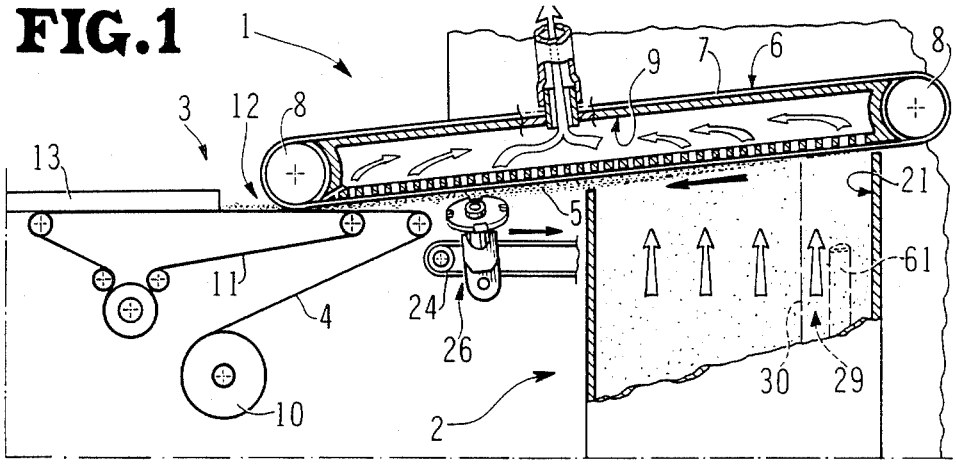
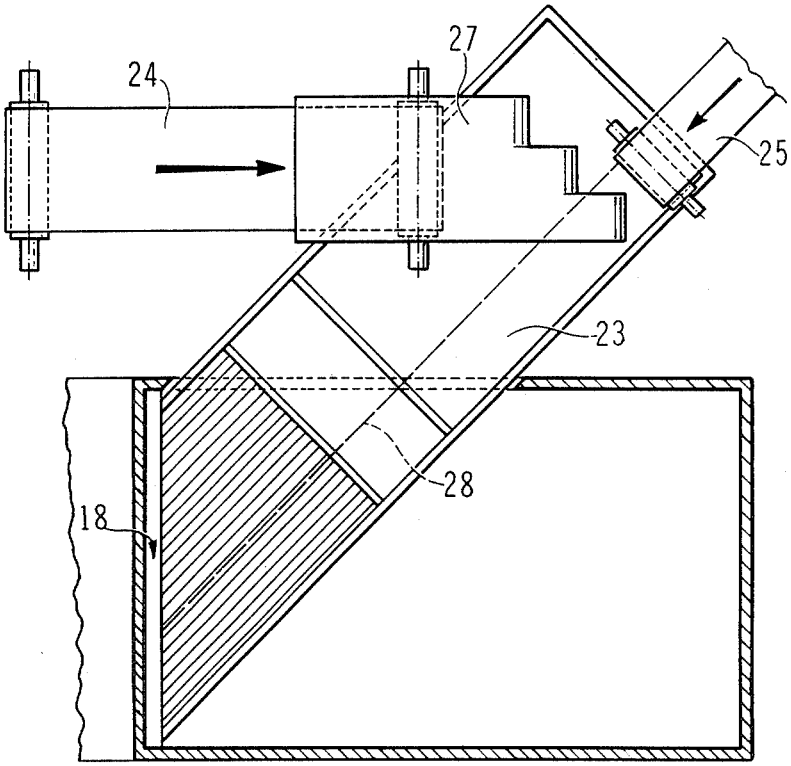
FIG.3

CIGARETTE MANUFACTURING MACHINE WITH A TOBACCO PARTICLE SEPARATOR

BACKGROUND OF THE INVENTION

The present invention relates to a cigarette manufacturing machine with a tobacco particle separator. On cigarette manufacturing machines, shredded tobacco is usually fed through an input feedbox to a bin inside which a carding unit feeds the tobacco into a down-flow duct. The bottom end of the said down-flow duct is usually connected to a well from which there extends upwards an up-flow duct the top end of which is closed off by a conveyor belt permeable by air. The tobacco from the said down-flow duct is usually deposited on to the said conveyor belt by means of suction exerted through the belt itself.

The suction exerted through the said conveyor belt is usually sufficient for forcing up, along the said up-flow duct, lighter tobacco particles consisting of dust and relatively minute shreds, whereas any lumps and/or woody particles drop down by force of gravity into the said well.

As only a small percentage of the material dropping into the well actually consists of waste material, all manner of attempts have been made, on known cigarette manufacturing machines, to separate the waste from the reclaimable material inside the said well, and to feed the reclaimed material back up along the said up-flow duct. For this purpose, extremely complex wells have been devised, inside which, air jets, differing in force and direction provide for unraveling any lumps, and for feeding any reclaimed lighter particles back up along the up-flow duct.

Known cigarette manufacturing machines of the aforementioned type present both structural and functional drawbacks.

In fact, the extremely complex structure of the well not only impairs reliability, but also results in inconsistent separation of the light and heavy tobacco particles inside the well itself, such separation depending on a relatively large number of parameters relating to the type and condition of the tobacco involved. For example, the damper the tobacco is, the poorer separation will be, in that damp tobacco tends to cling to the underside of the said permeable conveyor belt, thus minimising suction along the said up-flow duct and, consequently, also the force exerted for feeding back up the lighter particles separated inside the well. Consequently, any material failing to be fed back up along the up-flow duct, and which is therefore rejected by the machine usually comprises, not only the heavier tobacco particles, but also varying amounts of lighter particles, depending on the nature of the tobacco involved.

SUMMARY OF THE INVENTION

The aim of the present invention is to provide a cigarette manufacturing machine enabling tobacco particles suitable for cigarette manufacture to be fully separated in a simple and economic manner from waste tobacco particles, and enabling the said usable particles to be fed on to a conveyor belt permeable by air.

With this aim in view, according to the present invention, there is provided a cigarette manufacturing machine with a tobacco particle separator, said machine comprising a shredded tobacco supply unit, a unit for wrapping the said tobacco, and a conveyor belt permeable by air and extending between the said supply unit and the said wrapping unit, for transferring to the said wrapping unit a continuous layer of tobacco held by suction on to the said belt; the said supply unit comprising a down-flow duct for shredded tobacco, a well communicating with the bottom end of the said down-flow duct, and an up-flow duct for the said tobacco; the bottom end of the said up-flow duct communicating with the said well, and the top end of the said up-flow duct being closed by the said belt; and separating means for separating, from the said shredded tobacco, particles of the same unsuitable for cigarette manufacture, wherein the said separating means comprise a duct substantially in the shape of an upside-down U, and tubular connecting means extending between the said U-shaped duct and the said well; a first end of the said U-shaped duct communicating with a dump, and a second end of the said U-shaped duct communicating with the said down-flow duct.

BRIEF DESCRIPTION OF THE DRAWINGS

The present invention will be further described with reference to the accompanying drawings in which:

FIG. 1 shows a partially-sectioned side view of a cigarette manufacturing machine according to the teachings of the present invention;

FIG. 3 shows a schematic plan view of a detail in FIG. 2;

DETAILED DESCRIPTION OF THE INVENTION

Figure 2:
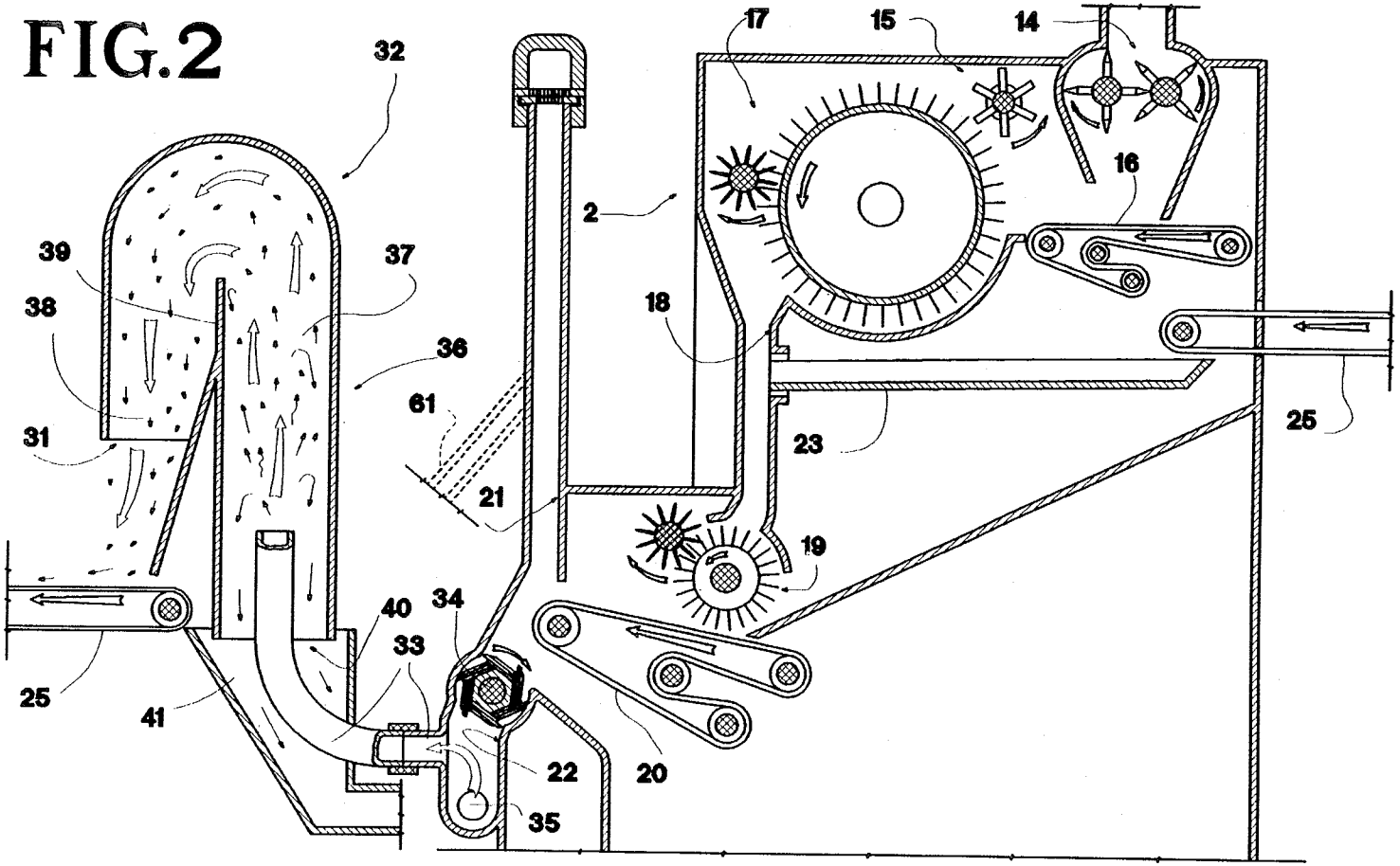
FIG. 2 shows a schematic section of a preferred embodiment of the machine in FIG. 1.

Number 1 in FIG. 1 indicates a cigarette manufacturing machine comprising a shredded tobacco supply unit 2, and a wrapping unit 3 designed to wrap inside a paper strip 4 a continuous layer 5 of tobacco supplied by unit 2 to unit 3 by means of a conveyor system indicated as a whole by 6 and comprising a conveyor belt 7 permeable by air and looped, by means of pulleys 8, about a suction or vacuum chamber 9.

Strip 4 is unwound from a reel 10 and fed on to a conveyor 11 extending through a filling station 12 in which tobacco layer 5 is fed on to strip 4. Strip 4 and superimposed tobacco layer 5 are then fed by conveyor 11 through a forming fixture 13 inside which the opposite side edges of strip 4 are folded, in known manner, about tobacco layer 5 and glued together to form a continuous cigarette rod (not shown) which is subsequently cut into pieces (not shown) by means of a cutting head (not shown).

As shown in FIG. 2, supply unit 2 comprises an input feedbox 14 through which shredded tobacco is fed into a bin 15 and on to a loop conveyor 16 designed to feed the shredded tobacco to a carding unit 17 housed inside bin 15. Carding unit 17 feeds the tobacco into a down-flow duct 18 the bottom end of which is controlled by a dispensing unit 19 which receives the tobacco from duct 18 and distributes it evenly on to conveyor 20. Conveyor 20 slopes slightly upwards towards the bottom end of an up-flow duct 21 the top end of which is closed by conveyor belt 7 and suction or vacuum chamber 9, and the bottom end of which communicates with drop-down well 22.

The respective widths of down-flow duct 18, conveyor 20 and up-flow duct 21, in the direction perpendicular to the FIG. 2 plane, are substantially identical with one another, as well as with the width of a substantially horizontal vibratory tray 23 one end of which communicates with an intermediate portion of duct 18, and the other end of which is located beneath the output end of two shredded tobacco conveyors 24 and 25 (also shown in FIG. 3).

As shown in FIG. 1, the input end of conveyor 24 is located beneath a shaving device 26, and is designed to receive shredded tobacco removed from layer 5 by shaving device 26, and to feed it back into duct 18 by means of vibratory tray 23.

For this purpose and as shown in FIG. 3, the output end of conveyor 24 consists of a baffle 27 arranged obliquely in relation to the underlying end of tray 23 in such a manner as to distribute evenly, over the entire width of the same, the tobacco removed from layer 5 by shaving device 26. The output end of conveyor 25, on the other hand, is arranged in such a manner as only to supply shredded tobacco on to a small lateral portion of tray 23, as indicated in FIG. 3 by dotted line 28. In like manner, the tobacco supplied by conveyor 25 engages only a narrow strip of both down-flow duct 18 and conveyor 20, and flows back up duct 21, engaging only a limited lateral portion 29 of the same, as shown by dotted line 30 in FIG. 1, the said portion 29 being located in the most upstream part of duct 21 in relation to the travelling direction of belt 7.

As shown in FIG. 2, the input end of conveyor 25 is connected to the outlet 31 of a separating device 32 the input of which consists of tubular means comprising a duct 33 extending outwards from well 22 which is closed at the top by a rotary non-return valve 34 and communicates at the bottom with the end of a compressed air supply circuit 35.

Separating device 32 comprises a duct 36 substantially in the shape of an upside-down U and consisting of an up-flow section 37 and a down-flow section 38 separated by a wall 39. Down-flow section 38 terminates at outlet 31, whereas up-flow section 37 presents a bottom end mouth 40 located inside dump box 41 through which is fitted duct 33, an output end portion of which is located inside a bottom portion of up-flow section 37.

In actual practice, the shredded tobacco fed into bin 15 through input feedbox 14 is first processed by carding unit 17, and then supplied by the same to the input of duct 18 down which the tobacco drops and blends uniformly over the entire width of duct 18 with shredded tobacco supplied by conveyor 24 and produced by device 26 shaving layer 5.

The tobacco dropping down from duct 18 on to dispensing unit 19 is supplied by the same, via conveyor 20, to the bottom end of up-flow duct 21 up which the tobacco is fed by virtue of the vacuum created by suction chamber 9 through belt 7.

In actual practice, not all the shredded tobacco supplied to the bottom end of duct 21 manages to flow up the same and adhere to the underside of belt 7 for being fed on to paper strip 4. In fact, the tobacco fed to duct 21 usually contains woody particles consisting of ribs of various length and lumps not unraveled by carding unit 17, which are prevented by their weight from flowing up duct 21. Such heavier particles drop down into well 22 and are fed by rotary valve 34 into separating device 32.

Once forced through duct 33 into duct 36 by the compressed air supplied by pneumatic circuit 35, the said heavier particles behave in two ways: the said lumps are usually unraveled by the swirl formed inside up-flow section 37 of duct 36, and the lighter particles so formed proceed, together with the lighter woody particles, along down-flow section 38 of duct 36 on the conveyor 25 and then on to vibratory tray 23. The heavier woody particles, on the other hand, drop directly into box 41 through the open bottom end of up-flow section 37 of duct 36.

As already stated, the tobacco supplied by conveyor 25 flows back up the lateral portion 29 of duct 21, said portion 29 being located upstream in relation to the travelling direction of conveyor 7, and is covered by the tobacco flowing back up the portion of duct 21 located further downstream. Consequently, the tobacco supplied by conveyor 25 is not subjected to the action of shaving device 26 which, otherwise, could send it back into circulation inside supply unit 2.

Figure 4:
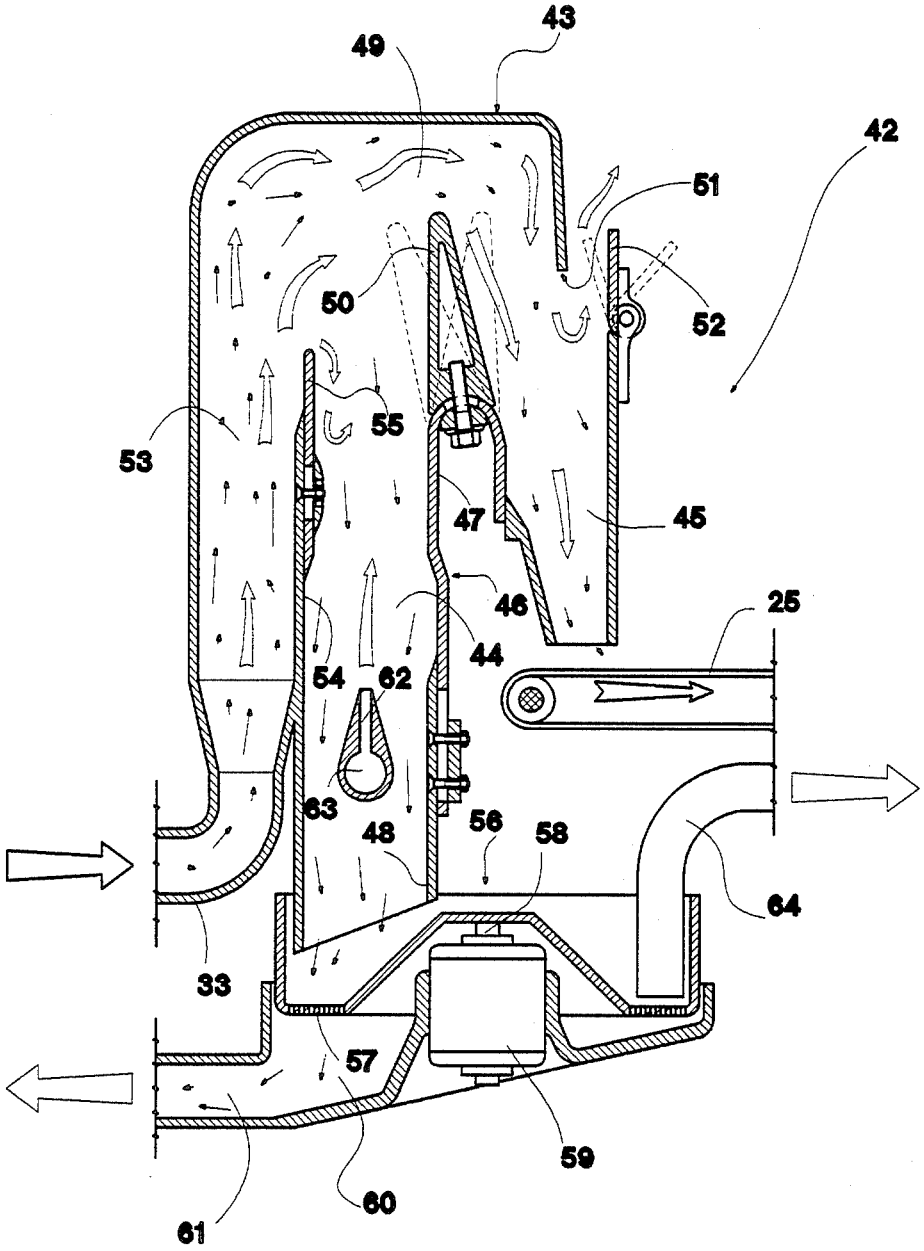
FIG. 4 shows a schematic section of a variation of a detail in FIG. 2.

The variation shown in FIG. 4 relates to a separating device 42 comprising a duct 43 substantially in the shape of an upside-down U and consisting of substantially vertical first and second sections, numbered respectively 44 and 45, separated by a wall 46 also substantially in the shape of an upside-down U. A top portion 47 of wall 46 is connected, in vertically adjustable manner, to a fixed bottom portion 48 of wall 46, in such a manner as to enable a first adjustment to the shape and size of an intermediate peak portion 49 of duct 43 through which communicate sections 44 and 45.

Further adjustment to the said peak portion 49 is provided for by a mobile end portion consisting of a baffle 50 extending upwards from the top end of top portion 47 of wall 46, and mounted in angularly adjustable manner in relation to the said wall 46.

Section 45 presents a lateral vent opening 51 controlled by a valve element 52, whereas peak portion 49 communicates with the output end of a duct 53, the input end of which communicates with well 22 via duct 33. An output end portion of duct 53 is separated from section 44 of duct 43 by a wall 54, a top portion 55 of which is vertically movable for adjusting the gap enabling communication between duct 53 and zone 49.

The open bottom end of section 44 of duct 43 comes out inside a rotary sifter 56. The said sifter 56 consists of a cup-shaped body open at the top, so as to receive the bottom end of section 44, and closed at the bottom by a pierced wall 57 connected integral with the output shaft 58 of a motor 59 and constituting the top cover of a feedbox 60 connected to duct 21 via a recycling duct 61 the output portion of which is shown by the dotted line in FIG. 2.

Section 44 is fitted inside with a nozzle 62 arranged upwards and communicating with a compressed air supply duct 63.

Finally, a dump pipe 64 is mounted with its input end facing wall 57, on the same side of wall 57 as section 44 of duct 43, so to enable dumping of the material failing to pass through sifter 56.

In actual practice, the material from duct 33 is forced up duct 53 by the compressed air from pneumatic circuit 35, the said material partly flowing past zone 49 joining sections 44 and 45 and falling directly into section 45, the open bottom end of which is located over conveyor 25, and partly falling into section 44. In more detail, the lighter particles and dust go directly into section 45, whereas the woody particles drop into section 44.

Of the said woody particles, the lighter ones are forced back up towards section 45, by the compressed air from nozzle 62, whereas the heavier ones drop into sifter 56. Of the said heavier woody particles, the relatively small ones pass through the holes in wall 57 and are sent back to duct 21 along duct 61, whereas the larger ones are trapped in sifter 56 and dumped out through pipe 64.

By adjusting the shape and size of zone 49 and opening 51, it is possible to adjust the percentage of waste tobacco separated from the tobacco stream supplied to separator 42 from duct 33.

Though separating devices 32 and 42 described herein are connected to a single cigarette manufacturing machine, needless to say, more than one cigarette manufacturing machine may be connected to a single separating device.

I claim:

1. A cigarette manufacturing machine (1) with a tobacco particle separator, said machine comprising a shredded tobacco supply unit (2), a unit (3) for wrapping the said tobacco, and a conveyor belt (7) permeable by air and extending between the said supply unit (2) and the said wrapping unit (3), for transferring to the said wrapping unit (3) a continuous layer (5) of tobacco held by suction on to the said belt (7); the said supply unit (2) comprising a down-flow duct (18) for shredded tobacco, a well (22) communicating with the bottom end of the said down-flow duct (18), and an up-flow duct (21) for the said tobacco; the bottom end of the said up-flow duct (21) communicating with the said well (22), and the top end of the said up-flow duct (21) being closed by the said belt (7); and separating means (32; 42) for separating, from the said shredded tobacco, particles of the same unsuitable for cigarette manufacture, the said separating means (32; 42) comprising a duct (36; 43) substantially in the shape of an upside-down U, and tubular connecting means (33) extending between the said U-shaped duct (36; 43) and the said well (22); a first end of the said U-shaped duct (36; 43) communicating with a dump (41; 64), and a second end of the said U-shaped duct (36; 43) communicating with the said down-flow duct (18).

2. A cigarette manufacturing machine (1) as claimed in claim 1, in which the said tubular connecting means comprises a duct (33) connected, at one end, to the said well (22), and presenting, at the other end, a section extending loosely through the said first end of the said U-shaped duct (36).

3. A cigarette manufacturing machine as claimed in claim 1, in which the said tubular connecting means comprises a duct (33) connected, at one end, to the said well (22), and, at the other end, to an intermediate peak portion (49) of the said U-shaped duct (43).

4. A cigarette manufacturing machine as claimed in claim 3, in which the said separating means (42) also comprises a sifter (56) and a recycling duct (61); the said first end of the said U-shaped duct (43) and the said dump (64) being located facing the said sifter (56) and on the same side of the same; and the input of the said recycling duct (61) communicating with the said first end of the said U-shaped duct (43) via the said sifter (56).

5. A cigarette manufacturing machine as claimed in claim 4, in which the output of the said recycling duct (61) communicates with the said up-flow duct (21).

6. A cigarette manufacturing machine as claimed in claim 3, in which blowing means are provided inside the said U-shaped duct (43) close to the said first end, for blowing air upwards and towards the said intermediate peak portion (49).

7. A cigarette manufacturing machine as claimed in claim 1, in which the said U-shaped duct (43) comprises two side-by-side sections (44, 45) sepatated by a wall (46) and communicating via the said intermediate peak portion (49); the said wall (46) comprising a mobile end portion (50) for regulating the free section and the shape of the said intermediate peak portion (49).

* * * * *

UNITED STATES PATENT AND TRADEMARK OFFICE

CERTIFICATE OF CORRECTION

PATENT NO. : 4,729,388

DATED : March 8, 1988

INVENTOR(S) : Riccardo Mattei

It is certified that error appears in the above-identified patent and that said Letters Patent is hereby corrected as shown below:

On the cover page, in the identifier line [73], change "Turin" to -- Bologna --.

Signed and Sealed this

Twenty-seventh Day of September, 1988

*Attest:*

DONALD J. QUIGG

*Attesting Officer*

*Commissioner of Patents and Trademarks*